United States Patent [19]

Smith

[11] Patent Number: 4,953,490

[45] Date of Patent: Sep. 4, 1990

[54] WAVE OPERATED BOAT PUMP

[75] Inventor: Winston J. Smith, 6550 Edgewater Dr., Erie, Mich. 48133

[73] Assignee: Winston J. Smith, Erie, Mich.

[21] Appl. No.: 454,439

[22] Filed: Dec. 19, 1989

[51] Int. Cl.[5] ..... B63B 13/00

[52] U.S. Cl. ..... 114/183.00 A; 114/185

[58] Field of Search ..... 114/183 R, 183 A, 184, 114/185, 186; 440/9, 10

[56] References Cited

U.S. PATENT DOCUMENTS

| | | | |
|---|---|---|---|
| 3,020,870 | 2/1962 | Skovranek | 114/183 A |
| 3,120,212 | 2/1964 | Delaney | 114/183 A |
| 3,191,538 | 6/1965 | Adams | 114/183 A |
| 3,289,592 | 12/1966 | Franzreb | 114/183 A |
| 3,362,336 | 1/1968 | Kafka | 114/183 R |

FOREIGN PATENT DOCUMENTS

| | | | |
|---|---|---|---|
| 801263 | 9/1958 | United Kingdom | 114/183 A |

*Primary Examiner*—Sherman Basinger
*Assistant Examiner*—Thomas J. Brahan

[57] ABSTRACT

This invention relates to a device that uses the rocking or pitching motion of a boat caused by wave action to operate a pump in said boat. Said device functions by being so connected as to use the relative motion between said rocking or pitching boat and a submerged plate that resists vertical motion as a means for operating said pump. The function of said pump and its related mechanism is to automatically discharge water overboard from bottom or bilge of said boat.

5 Claims, 1 Drawing Sheet

WAVE OPERATED BOAT PUMP

PART NUMBERS AND NAMES 1. mounting bracket
2. rocking arm
3. rocking arm pivot
4. connecting arm
5. submerged resistance plate
6. neutral buoyancy component
7. mounting bracket attachment means
8. rocking arm stop
9. diaphragm pump
10. rocking arm to pump diaphragm attachment bolt
11. bilge water intake check valve assembly
12. bilge water discharge check valve assembly
13. lower pumping tube
14. upper pumping tube
15. stand pipe tube
16. bilge water siphon discharge tube
17. point 17
18. point 18
19. bilge water siphon discharge float
20. boat gunwhale
21. water level outside and adjacent to boat
22. water level, bilge water inside boat.

BACKGROUND OF THE INVENTION

Being a small boat owner I am naturally familiar with the chore of manually bailing or pumping the accumulated rain-water out of a boat when no electrical power is available for an electric bilge pump. A friend of mine who also disliked the task of bailing out a boat commented that there must be a better way which led to my development of the invention of the wave powered boat pump that I am submitting for patent. As I worked on the development of my invention I became aware that prior patents had been granted for devices operated by wave action and/or boat motion but concluded my device and methods employed contained novel features and improvements on these prior inventions and was encouraged to proceed.

DESCRIPTION OF PREFERRED EMBODIMENT

The mounting bracket of the wave operated boat 1 is made of steel or other suitable materials and is so constructed that it is easily attached or removed from the oarlock socket 7 of said boat or may be attached at other locations on said boat by suitable means. Said mounting bracket provides attachment points for the rocking arm 2, diaphragm pump 9 and rocking arm stop 8. The rocking arm pivot 3 is made of steel or other suitable materials. It is attached to said rocking arm pivot by a suitable means that allows it to rock or pivot in a vertical plane. The outer end of said rocking arm extends out and over the surface of the water adjacent to the boat in approximately a horizontal position. The inner end of said rocking arm extends inward and over the interior of said boat.

The connecting arm 4 is made of steel or other suitable materials and is rigidly attached to the outer end of said rocking arm and extends downward to and below the surface of said water adjacent to the boat whereon the submerged resistance plate 5 is rigidly attached to end of said connecting arm.

The neutral buoyancy compent 6 is a suitable material attached to said submerged resistance plate to provide a neutral buoyancy condition.

The rocking arm stop 8 on said mounting bracket limits the travel of said rocking arm.

The diaphragm pump 9 has a pump body containing a cup shaped cavity. The upper or open side of said pump body has a flat surface around the periphery of said pump body FIG. 2 to retain the rubber diaphragm placed thereon. A retaining ring placed on top of said diaphragm has drilled holes for retaining bolts that pass through holes in said pump body. Said cup shaped cavity in said pump body is provided with a connection where upper pumping tube 14 is attached. The rocking arm attachment bolt 10 connects the diaphragm of said pump to the inner end of said rocking arm. Materials used in said diaphragm pump are steel, brass, aluminium and rubber though other suitable materials may be used.

The bilge water intake check valve assembly 11 is placed in the bottom or bilge of said boat where water collects. Said bilge water intake check valve assembly FIG. 5 consists of a tube closed on one end and with several screened openings in the tube wall for water intake. The open end of said tube is inserted and secured into a check valve body that permits only a one way flow of bilge water into the pumping system. Materials used in said bilge water intake check valve assembly are steel, fiberglass and plastic though other materials may be used.

The lower pumping tube 13 connects said bilge water intake check valve assembly 11 to the bilge water discharge check valve assembly 12. Said bilge water discharge check valve assembly is positioned so as to be above the level of the bilge water 22 in said boat and the water outside and adjacent 21 to said boat. The check valve in said bilge water discharge assembly connects to the "tee" fitting as shown in FIG. 3 which is the connecting point for the bilge water siphon tube 16 and the standpipe 15. Said bilge water siphon discharge tube is also positioned at points 17 and 18, FIG. 1 as to be below water levels 21 and 22 for prime retention purposes in said bilge water siphon discharge tube. Said standpipe tube attached to said bilge water discharge check valve assembly rises from that point to, above and over gunwhale of said boat.

The siphon tube discharge float 19 is a buoyant disk whereon the discharge end of said bilge water siphon discharge tube is attached so as to be above the level of water adjacent and outside 21 of said boat with said siphon tube discharge float being held in place but not restricted from free flotation by connecting arm 4.

All tubing in the pump assembly is flexible plastic transparent tubing although other suitable tubing may be used.

While only a single embodiment of the inventive wave operated boat pump FIG. 1 has been shown and described it is not limited thereby but only by the scope of the claims that follow.

DESCRIPTION OF THE OPERATION OF PRESENT INVENTION

Figure 4:
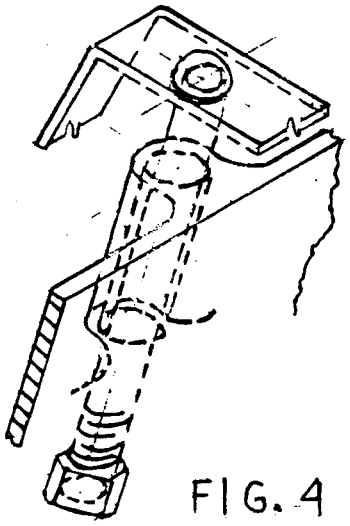
FIG. 4 is a enlarged projection drawing of the mounting bracket attachment means of said invention.

The function of mounting bracket 1 is to provide attachment means for the rocking arm 2, pivot point 3, rocking arm stop 8 and diaphragm pump 9. Mounting bracket attachment means 7 provides attachment for said mounting bracket to an oarlock socket on said boat FIG. 4.

The rocking arm 2 is attached to said pivot point 3 so as to rock or pivot. Connecting arm 4 is attached to outer end of said rocking arm and extended downward to a connection with submerged resistance plate 5. The function of said submerged resistance plate is to resist vertical motion through the water when a rocking motion of said boat occurs thereby causing said rocking arm to rock. Neutral buoyancy component 6 is attached to said submerged resistance plate to make it neutrally buoyant for the purpose of greater pumping efficiency.

The body of said diaphragm pump 9 is attached to the inner end of said mounting bracket 1 with the diaphragm of said pump being attached by rocking arm to diaphragm bolt 10 whereby said diaphragm movements cause a cycle of increasing and decreasing air pressure for bilge water pumping purposes in upper pumping tube 14, bilge water discharge check valve assembly 12, lower pumping tube 13 and bilge water intake check valve assembly 11.

Figure 5:
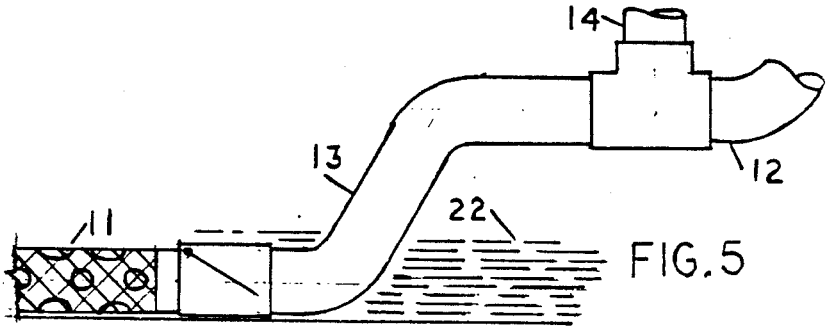
FIG. 5 is an enlarged side view of the bilge water intake check valve assembly of said invention.

Said bilge water intake check valve assembly FIG. 5 is placed in low point of said boat bottom and has multiple screened holes for water intake with said check valve permitting only an inward flow of said bilge water into said pumping tube 13.

Figure 3:
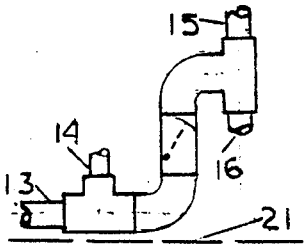
FIG. 3 is a enlarged side view drawing of the bilge water discharge check valve assembly of said invention.
Figure 2:
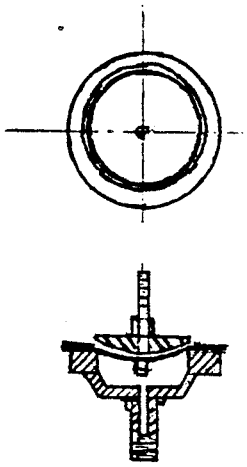
FIG. 2 is a cross section and top view drawing of the diaphragm pump of said invention.

The check valve in bilge water discharge check valve assembly FIG. 3 permits only a one way flow of said bilge water from the pumping side, upper pumping tube 14 to the discharge side outlet connecting to bilge water siphon discharge tube 16 and standpipe tube 15.

Figure 1:
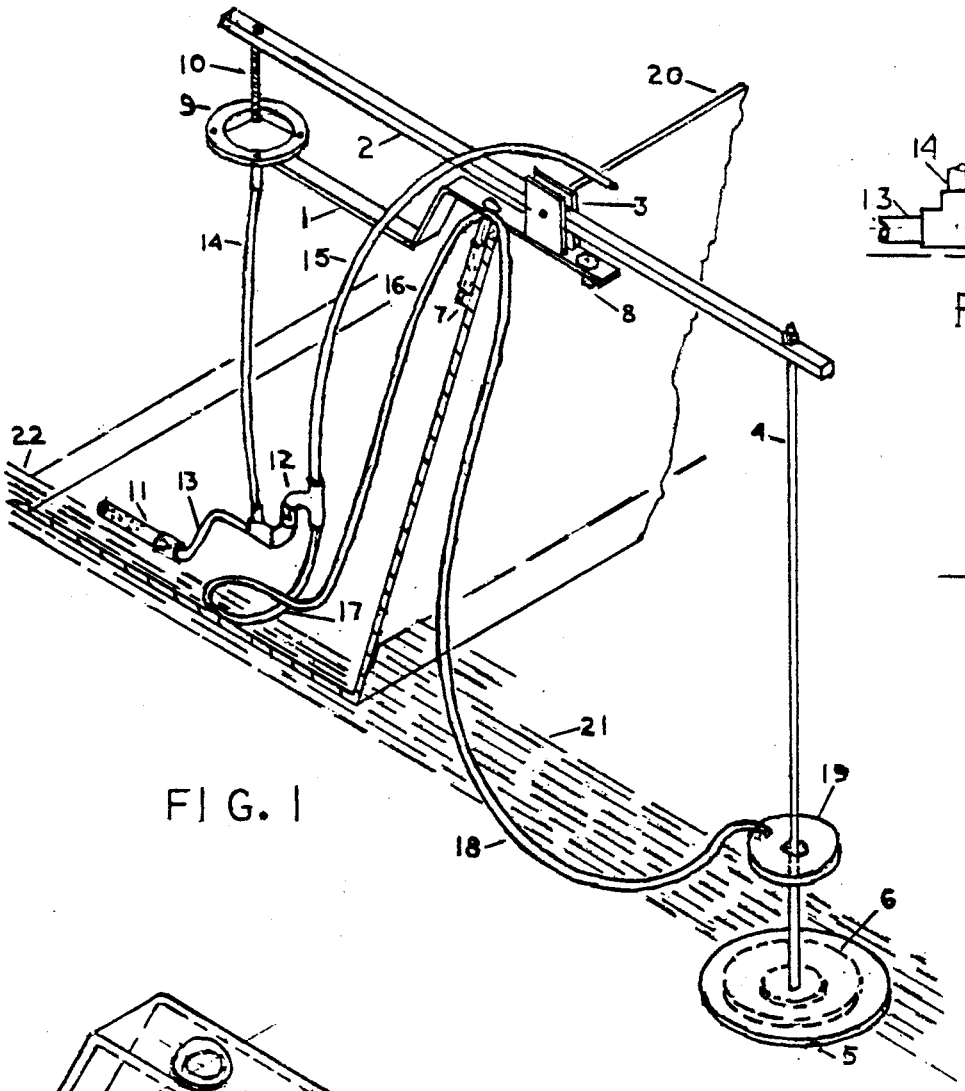
FIG. 1 is a projection drawing of my invention.

Said bilge water discharge siphon tube 16 functions to discharge bilge water from said boat as soon as pumping action is strong enough to raise water up to the bilge water outlet of said bilge water check valve assembly FIG. 3 and FIG. 1, 12. Said outlet is slightly above the level of the water outside and adjacent to said boat 21 so siphoning will take place. Said siphoning method being a means of discharging bilge water from said boat when pumping action caused by said boat motion is too weak to raise bilge water to said boat gunwhale level 20 to discharge it directly overboard.

Points 17 and 18 on said bilge water siphon discharge tube are so positioned that said tube is below the respective water levels 21 and 22 as a means of retaining prime in said tube. The bilge water siphon discharge tube float 19 serves as a means of holding the discharge end of said bilge water siphon discharge tube above said water level 21 to prevent back-siphoning of water into said boat.

The standpipe tube 15 connects to the top opening of the outlet side of said bilge water discharge check valve assembly 12 and rises vertically therefrom to, above and over gunwhale of said boat. In FIG. 1 it is seen that said diaphragm pump 9, said upper pumping tube 14, said bilge water discharge check valve assembly 12 and said standpipe tube 15 form a "U-Tube" configuration that is an essential part of the pumping system of the present invention. When transparent tubing is used in said pumping system the flow of bilge water can be seen and this said flow which I choose to call the "Yo-Yo" effect occurs.

Decreased air pressure from said diaphragm pump draws bilge water from bilge of said boat up into said upper pumping tube 14 forming a column of bilge water in said upper pumping tube. Said column height depends on the strength of said pumping action. Increased air pressure from said diaphragm pump in said pumping cycle pushes said column of bilge water in said upper pumping tube 14 down and across through said bilge water discharge check valve assembly into said outlet where a simultanious flow occurs in which part of said bilge water flow upwards into said standpipe to form a column of bilge water in said standpipe and the remainder of said bilge water flows downward into said bilge water siphon discharge tube. During the period in said pumping cycle when said bilge water is being drawn up into said upper pumping tube 14 said bilge water valve 12 and FIG. 3 closes and remainder of column formed in said standpipe tube drains down into said bilge water siphon discharge tube to be discharged overboard.

Said pumping system described functions accomplish the following: A column of bilge water in said standpipe 15 that: furnishes a higher bilge water head for increased flow in said bilge water siphon discharge tube 16; maintains a siphon flow in said bilge water siphon discharge tube when said bilge water discharge check valve is closed during said pumping cycle; maintains said bilge water siphon discharge tube prime and also discharges bilge water directly overboard from the top end of said standpipe tube 15 when pumping action of said diaphragm pump is strong enough.

I claim:

1. A wave operated boat pump comprising:
   - a diaphragm pump having an actuating attachment bolt;
   - a rocking arm coupled to said diaphragm pump through said actuating attachment bolt;
   - a pivoting means that allows said rocking arm to rock or pivot on a mounting bracket;
   - a rocking arm stop means positioned on said mounting bracket as to limit said rocking arm movement;
   - a submerged resistance plate linked to said rocking arm by a connecting arm;
   - a neutral buoyancy component attached to said submerged resistance plate;
   - said mounting bracket supporting said diaphragm pump, and including detachable installation means to a boat hull;
   - a bilge water discharge check valve assembly having an inlet side and an outlet side, said bilge water discharge check valve assembly connected to said diaphragm pump by an upper pumping tube, and said bilge water discharge check valve assembly also connected to a bilge water intake check valve assembly by a lower pumping tube;
   - a standpipe tube connected to said outlet side of said bilge water discharge check valve assembly;
   - a bilge water siphon discharge tube connected to said outlet side of said bilge water check valve assembly; and
   - a bilge water siphon discharge tube float having means for buoyantly supporting the discharge end of said bilge water siphon discharge tube.

2. A wave operated boat pump as recited in claim 1, wherein said bilge water siphon discharge tube is connected to said bilge water discharge check valve assembly as to have the connection above the level of the water outside of the boat, said bilge water siphon discharge tube extending downwardly to a level below the water level outside of the boat and then upwardly over the side of the boat and back downwardly to and below the outside water level and then up to the bilge water siphon tube float.

3. A wave operated boat pump as recited in claim 1, whereby said standpipe tube is connected to an upper opening at said outlet side of said bilge water discharge check valve assembly and rises therefrom in an essentially vertical direction to, above, and over the gunwale of the boat.

4. A wave operated boat pump as recited in claim 1, whereby said upper pumping tube is connected to the bottom side of said diaphragm pump and descends in an essentially vertical direction to a connection with a top opening of said bilge water discharge assembly, and said standpipe tube is connected to an upper opening of the said outlet side of said bilge water discharge assembly and rises in an essentially vertical direction to, above, and over the gunwale of said boat and then downward, giving the standpipe tube an overall U-shape for increased flow.

5. A wave powered boat pump as recited in claim 1, wherein said rocking arm is attached to said pivot means on said mounting bracket whereby said rocking arm extends outwardly from the boat gunwale in an essentially horizontal orientation beyond the boat so as to develope a large vertical motion for the outer end of said rocking arm at the point of attachment to said connecting arm.

* * * * *